US005543625A

United States Patent [19]

Johnson et al.

[11] Patent Number: 5,543,625

[45] Date of Patent: Aug. 6, 1996

[54] FILAMENT ASSEMBLY FOR MASS SPECTROMETER ION SOURCES

[75] Inventors: Bruce S. Johnson, Alameda County; Mukul Khosla, Santa Clara County, both of Calif.; John R. Herron, Corvallis, Oreg.; John M. Brassil; Alan E. Schoen, both of Santa Clara County, Calif.

[73] Assignee: Finnigan Corporation, San Jose, Calif.

[21] Appl. No.: 246,792

[22] Filed: May 20, 1994

[51] Int. Cl.[6] ..... H01J 27/00

[52] U.S. Cl. ..... 250/427

[58] Field of Search ..... 250/427, 423 R; 313/271, 2

[56] References Cited

U.S. PATENT DOCUMENTS

| | | | |
|---|---|---|---|
| 3,731,095 | 5/1973 | Komoda | 250/311 |
| 3,916,202 | 10/1975 | Heiting et al. | 250/403 |
| 4,540,884 | 9/1985 | Stafford et al. | 250/282 |
| 4,599,869 | 7/1986 | Ozin et al. | 62/55.5 |
| 5,028,791 | 7/1991 | Koshiishi et al. | 250/427 |

*Primary Examiner*—Bruce C. Anderson

*Attorney, Agent, or Firm*—Flehr, Hohbach, Test, Albritton & Herbert

[57] ABSTRACT

A filament assembly is disclosed for providing an electron beam to an ion source volume to ionize molecules or particles in the ion source volume. The filament assembly includes an electron lens which accelerates electrons emitted by the filament and focuses the electrons into a beam.

6 Claims, 2 Drawing Sheets

FILAMENT ASSEMBLY FOR MASS SPECTROMETER ION SOURCES

BRIEF DESCRIPTION OF THE INVENTION

This invention relates to a filament assembly for mass spectrometer ion sources, and more particularly, to a filament assembly that incorporates an integral electron lens.

BACKGROUND OF THE INVENTION

Mass spectrometers operate by selectively deflecting the trajectories of charged particles using electric and magnetic fields. An electric charge is induced on the constituent molecules of the sample to be analyzed in an ion source. There are many forms of ion source ionization such as electrospray, thermospray, corona discharge, fast atom bombardment, particle beam, chemical and electron impact. Chemical ionization, particle beam and electron impact ionization rely on the production of an electron beam which is accelerated to a chosen translational kinetic energy and directed to pass into and through a region of the ion source which contains the constituent molecules of the gaseous sample to be analyzed.

The electron beam is usually generated by passing an electric current through a refractory metal wire. The current heats the wire to a temperature where thermionic emission of electrons occurs. The filament is typically held in an electric field so that emitted electrons are accelerated from the hot filament in the direction of the gradient of the electric field. An axial magnetic field is used to constrain the motion of the electrons to a narrow beam. Any component of electron motion which is perpendicular to the magnetic lines of force acts to deflect the electrons into a spiral trajectory. The acceleration of the electrons through the electric field sets the translational kinetic energy of the electrons in the electron beam as they spiral along the magnetic lines of force through the ionization region. The translational energy affects the nature of the interaction between the gaseous sample molecules or particles and the electrons.

In an ion source for a magnetic sector or quadrupole mass spectrometer or an external ion source for ion injection into an ion trap, for example, the ions produced by interaction between the electron beam and the neutral sample molecules are extracted from the ionization region by a potential gradient between the ionization region and the mass analyzer.

Although the basics of ion source design draw upon fundamental principles, an ion source's quantitative performance depends upon the interaction of many subtle design characteristics. Ion source stability and sensitivity are important measures of a design, as are filament lifetime, and ion source serviceability. The electrons emitted from a filament are only useful if they pass through the ionization region and this has a significant effect on ion source sensitivity. A known design used for many years includes a hairpin-shaped filament. By using a hairpin-shaped filament and enclosing all but the tip of the hairpin in a metal shroud, electron emission can be limited to the exposed tip. Electrons which are emitted by the filament wire within the shroud pass to the shroud, which is electrically connected to one of the filament leads.

There are several problems associated with the filament assemblies used in electron impact or chemical ionization source. First, the filament produces a large amount of heat which may cause the temperature of the ionization source to reach undesirable temperatures or may cause uneven heating of the ionization region. Second, the high temperature of the filament causes the refractory metal of the filament to sublime. This creates weak spots in the filament and premature failure. Third, the high electron density or space charge of the electron beam creates a negative potential well. This potential well creates an alternate path for positive ions formed in the ionization region. The positive ions follow the electron beam back to the filament; this reduces the sensitivity of the ion source since those ions never enter the mass analyzer. Fourth, the ions which follow the electron beam back to the filament may bombard the filament, thus sputtering metal off the filament and shortening filament lifetime. Fifth, ions may deposit carbon residue in the filament region which may build up to form conductive whiskers that electrically short the filament to the ion source. Sixth, the filament wire is fragile. Typically, the filament assembly is removable. This wire is easily bent broken when the filament assembly is removed. Seventh, a change in the desired electron energy via a change in the filament bias changes the electric gradient at the filament. In the presence of a fixed magnetic field, this changes the electron trajectories and the overall efficiency of electron delivery to the ionization region.

OBJECTS AND BRIEF DESCRIPTION OF THE INVENTION

It is a general object of this invention to provide a filament assembly that overcomes many of the shortcomings of the prior art filament assemblies.

It is another object of the invention to provide an improved filament assembly that incorporates an electron lens.

It is another object of the invention to provide an improved filament assembly that incorporates a simple shroud surrounding a hairpin-shaped filament.

It is yet another object to provide a filament assembly that includes an electron lens held at a positive potential relative to both the filament and the ionization region of the ion source.

It is yet another object to provide a filament assembly that includes an electron lens held at a positive potential relative to the filament and negative relative to the ionization region.

The foregoing and other objects of the invention are achieved by a filament assembly apparatus which includes a filament for emitting electrons and a lens for accelerating and focusing electrons emitted by said filament. The invention includes a filament assembly having an insulating base that supports three electrical connections. Two of the electrical connections serve as filament support posts and the third provides support and electrical connection to an electron lens. A shield is pressed over the two filament support posts and electrically connected via a weld to one of the posts. A refractory metal filament wire is bent into the shape of a hairpin and welded to the filament posts. A shroud is placed over the filament such that only the tip of the filament extends through a hole in the shroud. The shroud is welded to the shield. An electron lens is placed over the filament and shroud and it is welded to the electron lens wires which protrude through sides of the insulating filament support block.

The three electrical connections which protrude from the insulating support allow the filament assembly to plug into a support socket which provides mechanical positioning of the filament assembly relative to the ion source block and which provides electrical connection to the filament and electron lens.

BRIEF DESCRIPTION OF THE DRAWINGS.

The foregoing and other objects of the invention will be more clearly understood from the following description when read in conjunction with the accompanying drawings, wherein.

DESCRIPTION OF THE PREFERRED EMBODIMENT

Figure 1:
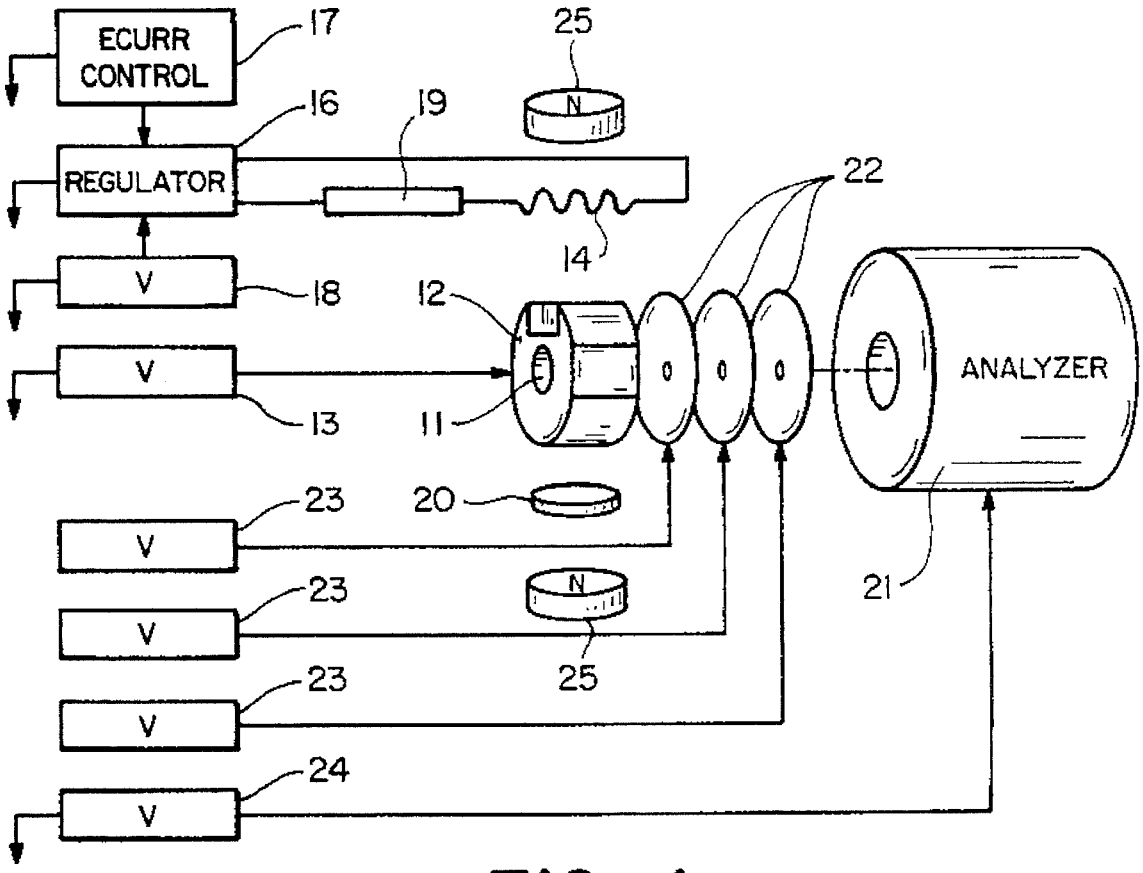
FIG. 1 schematically shows the operation of an ion source in accordance with prior art.

Referring to FIG. 1, a schematic diagram of a prior art ion source is shown. The ionization volume 11 is typically a cavity in a block of metal 12 which is biased at the ion source potential, which may be zero, by a bias voltage supply 13. A filament 14 is shown above the ion source block. There is typically an aperture (not shown) in the ion source block through which electrons pass from the filament into the ionization volume. The filament is heated by an electric current supplied by a current source 16 which is regulated by an emission current regulator 17. The filament assembly and the filament heater current source are biased relative to the ion source block by the filament bias voltage supply 18. The difference between the ion source bias voltage and the filament bias voltage establishes the kinetic energy of the electrons as they pass into and through the ionization region of the ion source. A resistor 19 is placed in the circuit somewhere between the filament bias supply and the filament. The emission current is monitored by monitoring the voltage drop across this series resistor. The emission current regulator sets the heater current to maintain a selected emission current. The emission current regulator provides electrical isolation of the current monitoring and feedback circuits from the ground referenced control circuits. An alternative design includes a collector 20 which is placed at the electron beam's exit from the far side of the ionization region. In this case, the emission regulator regulates the electron current: reaching the collector instead of the electron current leaving the filament. Ions are formed in the ionization region by interaction of the electron beams with molecules or particles in the ionization volume. The ions are extracted toward the mass analyzer 21 by ion source lenses 22, connected to appropriate lens bias voltage supplies 23. An analyzer bias supply 24 maintains the analyzer at a voltage relative to ground. The difference between the ion source voltage and the mass analyzer voltage establishes the kinetic energy of the ion beam as it enters the analyzer 21. In addition, a magnetic field is typically produced by including spaced permanent magnets 25 such that the resulting field is in line with desired electron path to constrain the trajectories of the electrons.

Figure 4:
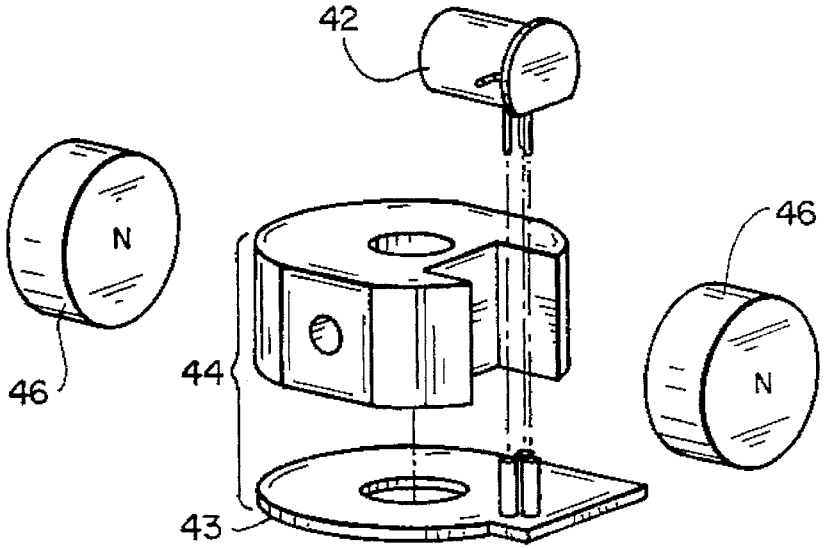
FIG. 4 is an exploded view of an ion source block and filament assembly support.
Figure 2:
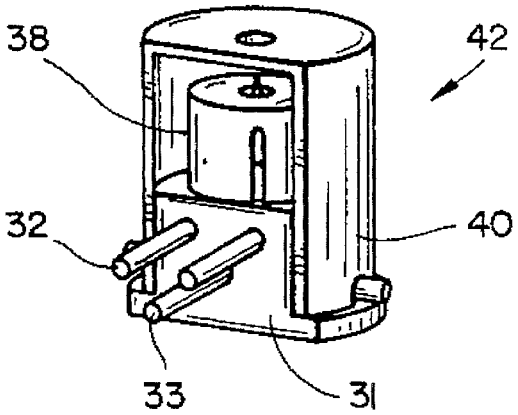
FIG. 2 shows a filament assembly in accordance with the invention.
Figure 3:
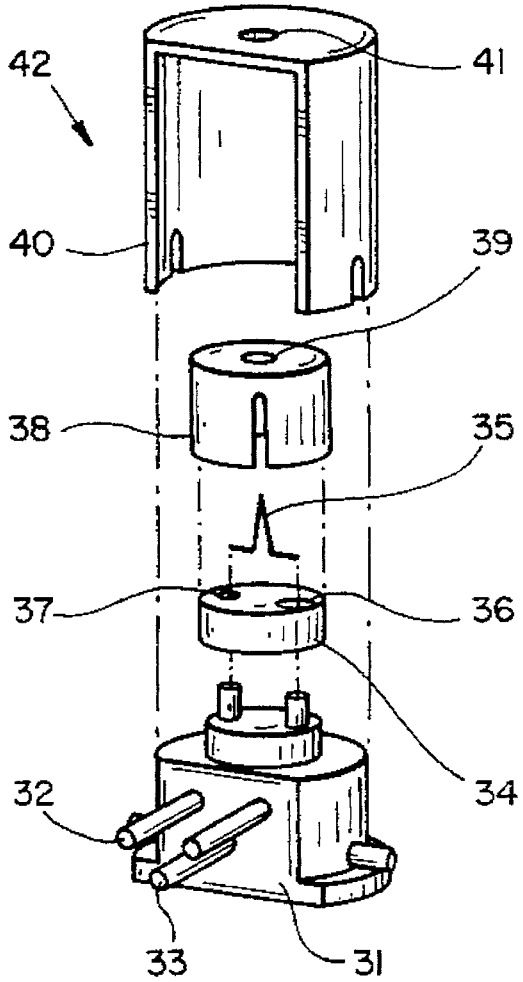
FIG. 3 is an exploded view of the filament assembly of FIG. 2.

Referring to FIG. 3, an exploded view of the improved filament assembly of FIG. 2 is shown. An insulating base 31 holds two L shaped filament support posts 32 and a T shaped electron lens support 33. The preferred method for fabrication of this part is to injection mold a glass-mica composite around the posts. A cup-shaped shield 34 is slipped over the posts until it rests against the insulator sides. One hole 36 in the shield clears one post while the other hole 37 fits snugly against the other post and is secured to the post by a weld. A shaded area formed by the gap between the shield and the filament support provides a region on the insulator which will not be exposed to the sublimed metal from the heated filament. This prevents a short circuit from forming as the metal vapor from the filament deposits on the cool surfaces. The filament 35 is a small diameter refractory metal wire or thin ribbon such as tungsten, rhenium, thoriated tungsten or thoriated tungsten rhenium. The wire is bent into a hairpin shape and spot welded to the filament support posts. A cup-shaped filament shroud 38 is placed over the filament such that the tip of the hairpin extends through a hole 39 in the shroud. The shroud is welded to the shield. The filament assembly is completed by a cup-shaped electron lens 40 which is carried by the base support with its electron hole 41 aligned with the filament. The lens is welded to the electron lens support. As shown in FIG. 4, the filament assembly 42 plugs into a three-socket connector 43 of the ion source assembly 44. The support provides mechanical support, spacing and electrical connection to the filament posts and lens support. Magnet 46 provide a magnetic field along the axis of the filament assembly.

The filament position places the heated tip of the hairpin in line with the axial magnetic field. The filament is biased at a negative voltage relative to the ion source block. The typical value used in electron impact ionization is 70 electron volts, although higher and lower voltages may be used. The electron lens is biased positive with respect to the ion source block. If this bias is set to 100 volts, for example, the potential from the filament to the electron lens is 170 volts, which is effective at extracting electrons from the heated filament 35. This allows the filament to operate at lower temperatures for a given emission current. In addition, the use of a positively biased electron lens allows efficient electron extraction with low filament bias relative to the ionization region. This permits very low final electron energies to be produced at higher emission currents. Other filament configurations can also be used with this arrangement, such-as linear or coiled filament wires. The preferred configuration, however, is the hairpin since only those electrons which are emitted close to the tip can exit the shroud. The electrons are accelerated toward the electron lens and pass through the aperture lens in line with the magnetic field. The magnetic field constrains the electron motion into a tight spiral. The electrons are then decelerated as they approach the ion source block to their final kinetic energy, which is equal to the difference between the filament bias and the ion source bias. The electrons are still constrained by the magnetic field and pass through the electron entrance aperture into the ionization volume or region of the ion source block. The electrons interact with sample molecules to form ions. The mechanisms for this interaction are well known in the art. The subtleties of ionization are controlled by setting the electron current and energy. The ionization efficiency and performance of an ion source using this filament configuration is enhanced by several mechanisms. First, 80% to 100% of the emitted current, as measured by monitoring the voltage drop across the series resistor, passes into the ionization region where the electrons may productively participate in ionization. Second, positioning a lens between the filament and the ion source block reduces the radiant heat which can cause uneven heating of the ionization region. Third, the lens is held at a positive potential relative to both the filament and the ionization region. This positive potential relative to the filament aids electron extraction from the filament which allows the filament to operate at a lower temperature at a given electron emission current. This lower temperature extends filament lifetime by reducing the rate of metal sublimation. Fourth, the positive potential relative to the ionization region effectively caps the ionization region space charge well to prevent positive ions from leaving the ion source via the electron hole. This allows the positive ions to be available for mass analysis. Fifth, since positive ions do not exit the source toward the filament, the filament life is extended by reducing any sputtering which may occur. Sixth, limiting the population of ions in the filament region reduces the formation of carbon whiskers. Seventh, by incorporating the electron lens into the filament assembly, the filament wire is mechanically protected between the lens and the filament support. Eighth, the lens bias may be used to adjust the electric field gradient at the filament to optimize the electron trajectories to maximize the efficiency of electron delivery to the ionization region.

While the preferred embodiments above describe a filament assembly incorporating the electron lens, the electron lens can also be supported separately in the described position with all of the mentioned performance advantages. By including the lens in the filament assembly, alignment is assured and the lens protects the filament from mechanical damage during shipping and handling.

What is claimed:

1. A filament assembly for projecting an electron beam into an ion source volume to ionize sample molecules or particles in the ion source volume, comprising:

a base formed of insulating material, spaced filament supports carried by said base, a hairpin-shaped filament carried by said spaced filament supports, and a shroud covering said filament and exposing a portion of the filament, and an electron lens having an electron hole opposite said filament spaced from said filament for accelerating and focusing electrons emitted by said filament through said hole.

2. A filament assembly as in claim 1 including spaced magnets providing a focusing magnetic field for said beam.

3. A filament assembly as in claim 1 including a shield electrically connected to one of said supports and to said shroud and shielding said base.

4. A filament assembly as in claim 1 wherein said electron lens is supported by said base.

5. A filament assembly for projecting an electron beam into an ion source volume to ionize sample molecules or particles in the ion source volume, comprising:

a base formed of insulating material, spaced filament supports carried by said base, a filament carried by said spaced filament supports, a shroud carried by said base covering said filament support and exposing a portion of the filament, a shield electrically connected to one of said supports and to said shroud and shielding said base, and an electron lens supported by said base and spaced from said exposed filament portion for accelerating and focusing electrons emitted by said filament.

6. A filament assembly as in claim 5 wherein said electron lens, shroud and shield are cup-shaped.

* * * * *